US012276013B1

(12) United States Patent
Shen et al.

(10) Patent No.: US 12,276,013 B1
(45) Date of Patent: Apr. 15, 2025

(54) CORROSION-RESISTANT OXIDE DISPERSION STRENGTHENED STEEL

(71) Applicant: SHANGHAI JIAOTONG UNIVERSITY, Shanghai (CN)

(72) Inventors: Zhao Shen, Shanghai (CN); Yiheng Wu, Shanghai (CN); Xiaoqin Zeng, Shanghai (CN); Xujia Wang, Shanghai (CN); Ling Li, Shanghai (CN); Yibin Tang, Shanghai (CN)

(73) Assignee: SHANGHAI JIAOTONG UNIVERSITY, Shanghai (CN)

( * ) Notice: Subject to any disclaimer, the term of this patent is extended or adjusted under 35 U.S.C. 154(b) by 0 days.

(21) Appl. No.: 18/920,894

(22) Filed: Oct. 19, 2024

(30) Foreign Application Priority Data

Oct. 24, 2023 (CN) ..... 202311380991.6

(51) Int. Cl.

| | |
|---|---|
| ***C22C 38/06*** | (2006.01) |
| ***C22C 33/02*** | (2006.01) |
| ***C22C 38/00*** | (2006.01) |
| ***C22C 38/18*** | (2006.01) |

(52) U.S. Cl.
CPC ..... *C22C 33/0228* (2013.01); *C22C 38/002* (2013.01); *C22C 38/004* (2013.01); *C22C 38/005* (2013.01); *C22C 38/06* (2013.01); *C22C 38/18* (2013.01)

(58) Field of Classification Search
None
See application file for complete search history.

(56) References Cited

FOREIGN PATENT DOCUMENTS

| | | | | |
|---|---|---|---|---|
| CN | 110709529 | A | | 1/2020 |
| CN | 110760760 | A | * | 2/2020 |
| CN | 111057958 | A | | 4/2020 |
| CN | 116287953 | A | | 6/2023 |
| GB | 1214428 | A | | 12/1970 |
| RU | 0002785220 | C1 | | 12/2022 |
| WO | 2022213590 | A1 | | 10/2022 |

OTHER PUBLICATIONS

Machine translation of CN 110760760A. (Year: 2020).*
Machine translation of CN110709529A. (Year: 2020).*

* cited by examiner

*Primary Examiner* — Xiaowei Su
(74) *Attorney, Agent, or Firm* — Ming Jiang; OPENPTO US LLC

(57) ABSTRACT

Provided are a corrosion-resistant oxide dispersion strengthened steel and a method for preparing the corrosion-resistant oxide dispersion strengthened steel. The corrosion-resistant oxide dispersion strengthened steel includes in percentage by mass: Cr at 8.0 wt %-10.0 wt %, Al at 4.0 wt %-6.0 wt %, Ce at 0.2 wt %-0.8 wt %, Y at 0.2 wt %-0.4 wt %, O at 0.05 wt %-0.3 wt %, C less than or equal to 0.0016 wt %, and the balance of Fe.

5 Claims, 3 Drawing Sheets

CORROSION-RESISTANT OXIDE DISPERSION STRENGTHENED STEEL

CROSS REFERENCE TO RELATED APPLICATION

This application claims priority to a Chinese patent application No. 202311380991.6, filed on Oct. 24, 2023, and the entirety of which is incorporated by reference herein.

TECHNICAL FIELD

The disclosure relates to the technical field of new structural materials, and particularly to a corrosion-resistant oxide dispersion strengthened steel.

BACKGROUND

As nuclear reactor cladding serves as the first safety barrier of nuclear reactor, the performance of such cladding is directly related to whether the nuclear reactor can operate safely and reliably. Zirconium alloy is mainly used for the cladding nowadays. However, the reaction between the zirconium alloy and high-temperature water steam would produce hydrogen and a large amount of heat, which may lead to the melting of core and hydrogen explosion accidents. Based on the consideration of safety of the nuclear reactor, the design and optimization of oxide dispersion strengthened steel (ODS steel), which is a candidate material for cladding, has drawn much attention worldwide. High-density nano-scale oxide particles distributed in the ODS steel can hinder dislocation motion, thus improving the strength of the alloy. They can also act as sinks for irradiation-induced defects to resist the effects of irradiation on the alloys, which has broad application prospects.

At present, the ODS steel with high Cr content is prone to brittleness under service temperature and irradiation conditions, while the ODS steel with low Cr content has poor corrosion resistance. Therefore, measures are needed to solve such contradiction and prepare an ODS steel with excellent comprehensive properties.

SUMMARY

In view of the above, the disclosure provides a corrosion-resistant oxide dispersion strengthened steel, which includes, in percentage by mass, Cr at 8.0 wt %-10.0 wt %, Al at 4.0 wt %-6.0 wt %, Ce at 0.2 wt %-0.8 wt % of, Y at 0.2 wt %-0.4 wt %, O at 0.05 wt %-0.3 wt %, C less than or equal to 0.0016 wt %, and balance of Fe.

The method for preparing the corrosion-resistant oxide dispersion strengthened steel includes: preparing materials comprising, in percentage by mass, Cr powder at 8.0 wt %-10.0 wt %, Al powder at 4.0 wt %-6.0 wt %, oxygen-containing Ce powder at 0.21 wt %-1.0 wt %, $Y_2O_3$ powder at 0.3 wt %-0.5 wt %, and balance of Fe powder, and making FeCrAl pre-alloyed powder by using the Cr powder, the Al powder and the Fe powder through gas atomization; mixing the FeCrAl pre-alloyed powder with the oxygen-containing Ce powder and the $Y_2O_3$ powder, and performing ball milling on the mixed powder; and sintering alloyed powder obtained after the ball milling, thereby obtaining the corrosion-resistant oxide dispersion strengthened steel. The ball milling is performed at a rotation speed of 220 rpm-350 rpm, a ball-to-powder ratio is 10:1-15:1, the ball milling is performed in an intermittent mode, a total working time is 36 h-64 h, the intermittent mode includes stopping the ball milling for 15 min-60 min after every operation of 30 min-120 min, and the ball milling is performed under a gas pressure of 100 bar-1000 bar. The sintering adopts a stepwise sintering method, and includes: under a pressure of 50 MPa-100 MPa, first raising a temperature to 700° C.-850° C. and keeping it for 5 min-10 min, then raising the temperature to 1000° C.-1200° C. and holding it for 5 min-10 min, thereafter lowering the temperature to a room temperature, and the temperature is raised and lowered both at a rate of 50° C./min-120° C./min.

BRIEF DESCRIPTION OF THE DRAWINGS

In order to more clearly illustrate technical solutions in the embodiments of the disclosure or the related art, drawings to be used in the embodiments are briefly described below. Apparently, the following drawings are merely some embodiments of the disclosure, and those skilled in the art can obtain other drawings according to these drawings without paying any creative effort.

DETAILED DESCRIPTION OF PREFERRED EMBODIMENTS

Figure 1:
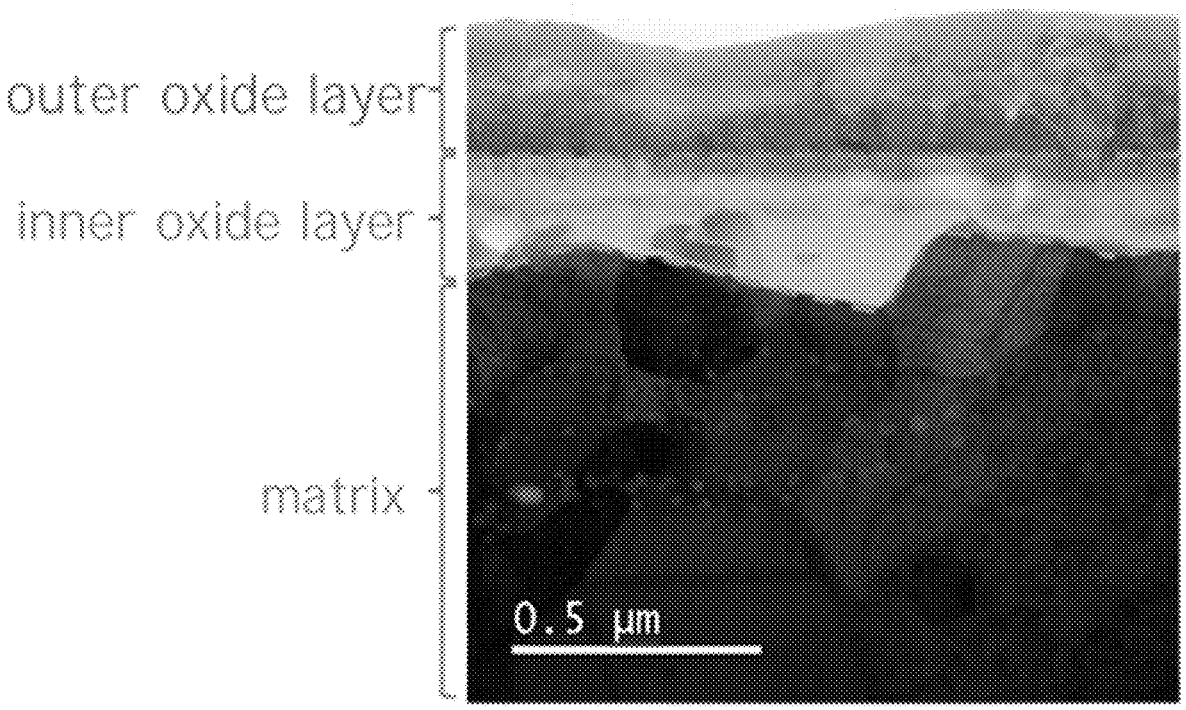
FIG. 1 illustrates a cross-sectional morphology diagram of an oxide on a surface of corrosion-resistant ODS steel prepared in Example 1 after being exposed to high temperature air at 600° C. for 5000 h.

Various exemplary embodiments of the disclosure are now described in detail. The detailed description should not be construed as limitations of the disclosure, but should be understood as detailed description of certain aspects, features and embodiments of the disclosure.

It is understood that the terms in the disclosure are only for describing particular embodiments, and are not used to limit the disclosure. In addition, for the ranges of values in the disclosure, it is to be understood that each intermediate value between the upper and lower limits of the range is also specifically disclosed. Each small range between any stated value or intermediate value within a stated range, and any other stated value or intermediate value within a stated range are also included in the disclosure. The upper and lower limits of these small ranges may be independently included or excluded from the scope.

Unless otherwise stated, all technical and scientific terms used herein have the same meaning as commonly understood by those of ordinary skill in the field described in the disclosure. Although the disclosure describes only preferred methods and materials, any methods and materials similar or equivalent to those described herein may also be used in the implementation or testing of the disclosure. All documents mentioned in this specification are incorporated by reference to disclose and describe methods and/or materials related to the documents. In case of conflict with any incorporated document, the contents of this specification shall prevail.

It is obvious to those skilled in the art that many improvements and changes can be made to the specific embodiments of the disclosure without departing from the scope or spirit of the disclosure. Other embodiments obtained from the specification of the disclosure will be apparent to the skilled person. The specification and examples of the disclosure are only exemplary.

As used herein, the terms "comprising", "including", "having", "containing", etc., are all open-ended terms, i.e. meaning including but not limited to.

According to the disclosure, the Cr content of ODS-FeCrAl steel is controlled to be in a low range of 8.0-10.0 wt %, thus the brittleness of the steel is reduced. In addition, the grain boundary density of the steel is improved through high-pressure and high-energy ball milling and step-wise spark plasma sintering, and the outward diffusion of Cr along the grain boundaries is promoted by adding rare earth Ce, so as to synergistically promote effective formation of a $Cr_2O_3$ protective film on the steel in a high-temperature corrosive environment, thereby improving corrosion-resistance and high-temperature oxidation-resistance of the steel. In addition, high-density nano-oxides with core-shell structure that are formed by Ce and $Y_2O_3$ helps to improve mechanical properties of the steel.

For this, the disclosure provides technical solutions as follows.

The embodiments of the disclosure provide a corrosion-resistant oxide dispersion strengthened steel, which includes, in percentage by mass, Cr at 8.0 wt %-10.0 wt %, Al at 4.0 wt %-6.0 wt %, Ce at 0.2 wt %-0.8 wt % of, Y at 0.2 wt %-0.4 wt %, O at 0.05 wt %-0.3 wt %, C less than or equal to 0.0016 wt %, and balance of Fe.

Furthermore, Cr is derived from Cr powder, Al is derived from Al powder, Ce is derived from oxygen-containing Ce powder, Y is derived from $Y_2O_3$ powder, O is derived from the $Y_2O_3$ powder and the oxygen-containing Ce powder, and Fe is derived from Fe powder. The oxygen-containing Ce powder is obtained by performing oxygen adsorption on Ce powder. C is an impurity in the Cr powder, the Al powder, the Ce powder, the $Y_2O_3$ powder, and the Fe powder.

Furthermore, raw materials of the corrosion-resistant oxide dispersion strengthened steel include, in percentage by mass, the Cr powder at 8.0 wt %-10.0 wt %, the Al powder at 4.0 wt %-6.0 wt %, the oxygen-containing Ce powder at 0.21 wt %-1.0 wt % (a mass fraction of the oxygen-containing Ce powder is a total mass fraction of the Ce powder and O adsorbed in the Ce powder, where the Ce powder is at 0.2 wt %-0.8 wt %), and the $Y_2O_3$ powder at 0.3 wt %-0.5 wt %, and balance of the Fe powder.

Furthermore, a purity of the Cr powder is 99.999%, a purity of the Al powder is 99.999%, a purity of the Ce powder is 99.999%, a purity of the $Y_2O_3$ powder is 99.999%, and a purity of the Fe powder is 99.999%.

Furthermore, the corrosion-resistant oxide dispersion strengthened steel uses FeCrAl as a matrix, and cerium yttrium oxide nano-particles with core-shell structure are dispersively distributed in the matrix.

Furthermore, a core of the cerium yttrium oxide nano-particle with core-shell structure is a cerium yttrium oxide (Ce—Y—O) core, and a shell thereof is enriched in chromium and aluminum (that is, the shell is a Cr-and-Al rich shell). A particle size of the cerium yttrium oxide nano-particle with core-shell structure is 2 nm-100 nm.

The Ce—Y—O core is formed by in-situ reaction occurring between the oxygen-containing Ce powder and the $Y_2O_3$ powder, and the shell enriched in chromium and aluminum (i.e., the Cr-and-Al rich shell) is formed on a surface of the cerium yttrium oxide (Ce—Y—O).

According to the technical solution of the disclosure, the content of Cr is selected reasonably, which alleviates the brittleness under service temperature and irradiation conditions that would otherwise be caused by too high Cr content in the existing technical solutions. The addition of the rare earth Ce helps to promote the diffusion of Cr, which overcome the deficiency that it is difficult for the steel with low Cr content (especially less than 10 wt %) to effectively generate a $Cr_2O_3$ protective film in the high-temperature corrosive environment for corrosion resistance.

The embodiments of the disclosure further provide a method for preparing the above-mentioned corrosion-resistant oxide dispersion strengthened steel. The method includes: preparing materials including, in percentage by mass, Cr powder at 8.0 wt %-10.0 wt %, Al powder at 4.0 wt %-6.0 wt %, oxygen-containing Ce powder at 0.21 wt %-1.0 wt % (a mass fraction of the oxygen-containing Ce powder is a total mass fraction of Ce powder and O adsorbed in the Ce powder, where the Ce powder is at 0.2 wt %-0.8 wt %), $Y_2O_3$ powder at 0.3 wt %-0.5 wt %, and balance of the Fe powder; making FeCrAl pre-alloyed powder by using the Cr powder, the Al powder and the Fe powder through gas atomization; mixing the FeCrAl pre-alloyed powder with the oxygen-containing Ce powder and the $Y_2O_3$ powder, and performing ball milling on the mixed powder; and sintering alloyed powder obtained after the ball milling, thereby obtaining the corrosion-resistant oxide dispersion strengthened steel.

Because the content of an impurity C in the Cr powder, the Al powder, the oxygen-containing Ce powder and the $Y_2O_3$ powder is extremely low, the mass content of the Cr powder, the Al powder, the Fe powder and other components in the actual formulation is almost equal to the mass content of the corresponding components in the finished corrosion-resistant oxide dispersion strengthened steel.

Furthermore, a particle size of the FeCrAl pre-alloyed powder is 1 μm-10 μm, and a particle size of the $Y_2O_3$ powder is 50 nm-1 μm.

Furthermore, the oxygen-containing Ce powder is obtained by performing oxygen adsorption on the Ce powder. In the oxygen-containing Ce powder, the mass of oxygen is 5 wt %-25 wt % of the mass of the Ce powder. A particle size of the Ce powder is 50 nm-1 μm.

Furthermore, performing the oxygen adsorption includes: introducing dry oxygen into a container for 5 min-20 min in advance, then quickly putting the Ce powder into the container, and continuously introducing the dry oxygen until the mass of the Ce powder is increased by 5 wt %-25 wt %.

Furthermore, the ball milling is performed at a rotation speed of 220-350 rpm, a ball-to-powder ratio is 10:1-15:1, the ball milling is performed in an intermittent mode, and a total operating time is 36 h-64 h.

Furthermore, performing the ball milling in the intermittent mode specifically includes: stopping the ball milling for 15 min-60 min after every operation of 30 min-120 min.

Furthermore, the ball milling is performed under a gas pressure of 100 bar-1000 bar.

Furthermore, the ball milling is performed in a protective atmosphere of high-purity argon.

Furthermore, the sintering is carried out by a step-wise sintering method, and specifically includes: under a pressure of 50 MPa-100 MPa, first raising the temperature to 700° C.-850° C. and then keeping it for 5 min-10 min; thereafter, raising the temperature to 1000° C.-1200° C. and then keeping it for 5 min-10 min; finally, lowering the temperature to a room temperature. The temperature is raised and lowered both at a rate of 50° C./min-120° C./min.

The step-wise sintering method is helpful to improve the density and structure uniformity of the alloy, and enable the grain size of the alloy to be in a low range.

The disclosure has technical effects as follows.

(1) In the FeCrAl ODS steel provided by the disclosure, the content of Cr is 8.0 wt %-10.0 wt %. Such low Cr content is helpful to solve the potential problems of brittleness in the service temperature and irradiation conditions that would otherwise be caused by too high Cr content in the related art.

(2) According to the disclosure, the rare earth Ce is added into the FeCrAl steel. The rare earth Ce helps to promote the outward diffusion of Cr along the grain boundaries, which overcomes the deficiency that it is difficult for the steel with low Cr content (especially less than 10 wt %) to effectively generate the $Cr_2O_3$ protective film in the high-temperature corrosive environment for corrosion resistance. In addition, Ce after being subjected to special oxygen adsorption can form, together with $Y_2O_3$, nano-oxide particles with complete core-shell structure, which is helpful to improve the mechanical properties of the alloy (Ce adsorbed with O can react with $Y_2O_3$ in situ, which avoids a relatively strong direct reaction between Ce and $Y_2O_3$; as such, the stress state at the interface between the nano-oxide particles and the matrix during the formation of nano-oxide particles is improved, thereby promoting the formation of cerium yttrium oxide with core-shell structure, alleviating the stress concentration around hard nano-oxides, and improving the toughness of the ODS steel).

(3) According to the disclosure, the alloy with small grain size and high grain boundary density can be effectively obtained by the high-pressure and high-energy ball milling and step-wise spark plasma sintering, which is conducive to the outward diffusion of Cr along the grain boundaries and the formulation of the $Cr_2O_3$ protective film in the high-temperature corrosive environment, thereby improving the corrosion resistance of the alloy.

The disclosure is further described below in connection with specific embodiments.

In the following embodiments, a purity of the Cr powder is 99.999%; a purity of the Al powder is 99.999%; a purity of the Ce powder is 99.999%, and a particle size of the Ce powder is 50 nm; a purity of the $Y_2O_3$ powder is 99.999%, and a particle size of the $Y_2O_3$ powder is 50 nm; and a purity of the Fe powder is 99.999%.

In the following embodiments, the preparation operation of the oxygen-containing Ce powder, that is, the operation of performing the oxygen adsorption on the Ce powder, includes: introducing dry oxygen into a container for 10 min in advance, then quickly putting the Ce powder (a particle size thereof is 50 nm) into the container, and continuously introducing the dry oxygen until the mass of the Ce powder is increased by 5 wt %-25 wt %.

Example 1

A corrosion-resistant oxide dispersion strengthened steel was prepared as follows.

At S1, materials including 9 wt % Cr powder, 4.5 wt % Al powder, 0.46 wt % oxygen-containing Ce powder (including 0.4 wt % Ce powder and 0.06 wt % O, that is, the mass of oxygen was 15 wt % of the mass of the Ce powder in the oxygen-containing Ce powder), 0.35 wt % $Y_2O_3$ powder and the balance of Fe powder were prepared, and FeCrAl pre-alloyed powder was made by using the Fe powder, the Cr powder and the Al powder through gas atomization, where an average particle size of the FeCrAl pre-alloyed powder was 5 μm.

At S2, the FeCrAl pre-alloyed powder prepared in step S1 was mixed with the prepared amounts of the oxygen-containing Ce powder and the $Y_2O_3$ powder in a vacuum glove box, the mixed powder was put into a ball mill tank which was in turn assembled into a high-energy ball mill equipped with a gas pressurizing device, and ball milling was performed. An internal gas pressure of the tank was 500 bar, the ball milling was performed at a rotation speed of 300 rpm, a ball-to-powder ratio was 15:1, and the ball milling was performed in an intermittent mode in which the ball milling stopped for 15 minutes after every operation of 45 minutes. A total working time was 50 h, and the ball milling was performed in a protective atmosphere of high-purity argon.

At S3, after completion of the ball milling, the alloyed powder obtained by the ball milling was put into a mold which was in turn placed into a spark plasma sintering furnace, and the alloyed powder was subjected to sintering through a step-wise sintering method. The sintering process was as follows: under a pressure of 80 MPa, a temperature was first raised at a rate of 100° C./min to 780° C. and then kept for 8 min; thereafter, the temperature was raised at the rate of 100° C./min to 1130° C. and the kept for 8 min; finally, the temperature was lowered at a rate of 100° C./min to a room temperature, thereby obtaining the product taken out of the mold as the corrosion-resistant oxide dispersion strengthened steel (ODS-FeCrAl steel, referred to as ODS steel for short). The ODS-FeCrAl steel obtained in this example included: 8.96 wt % Cr, 4.38 wt % Al, 0.38 wt % Ce, 0.28 wt % Y, 0.14 wt % O, 0.0011 wt % C, and the balance of Fe.

FIG. 1 illustrates a cross-sectional morphology diagram of an oxide on a surface of the corrosion-resistant ODS steel prepared in Example 1 after being exposed to high temperature air at 600° C. for 5000 h. It can be seen that the corrosion resistance of the corrosion-resistant ODS steel was excellent, and an average thickness of the oxide layer was 436 nm (which refers to a total thickness of an outer oxide layer and an inner oxide layer, in which a main component of the outer oxide layer was $Al_2O_3$, and a main component of the inner oxide layer was $Cr_2O_3$).

Figure 2:
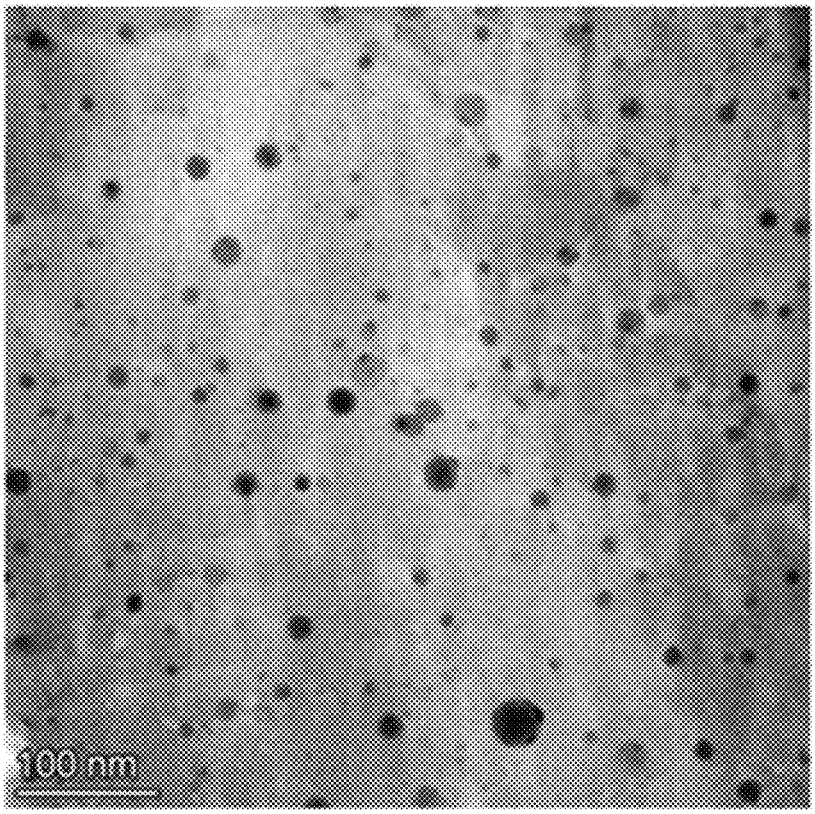
FIG. 2 illustrates a high-angle annular dark field scanning transmission electron microscopy (HAADF-STEM) image for high-density nano-oxides with core-shell structure in the corrosion-resistant ODS steel prepared in Example 1.

FIG. 2 illustrates a high-angle annular dark field scanning transmission electron microscopy (HAADF-STEM) image for high-density nano-oxides with core-shell structure in the corrosion-resistant ODS steel prepared in Example 1. As can be seen from FIG. 2 that there are high-density nano-oxides with core-shell structure in the corrosion-resistant ODS steel prepared in Example 1, which are evenly distributed within the grains and on the grain boundaries, with an average particle size of 7.42 nm.

Figure 3:
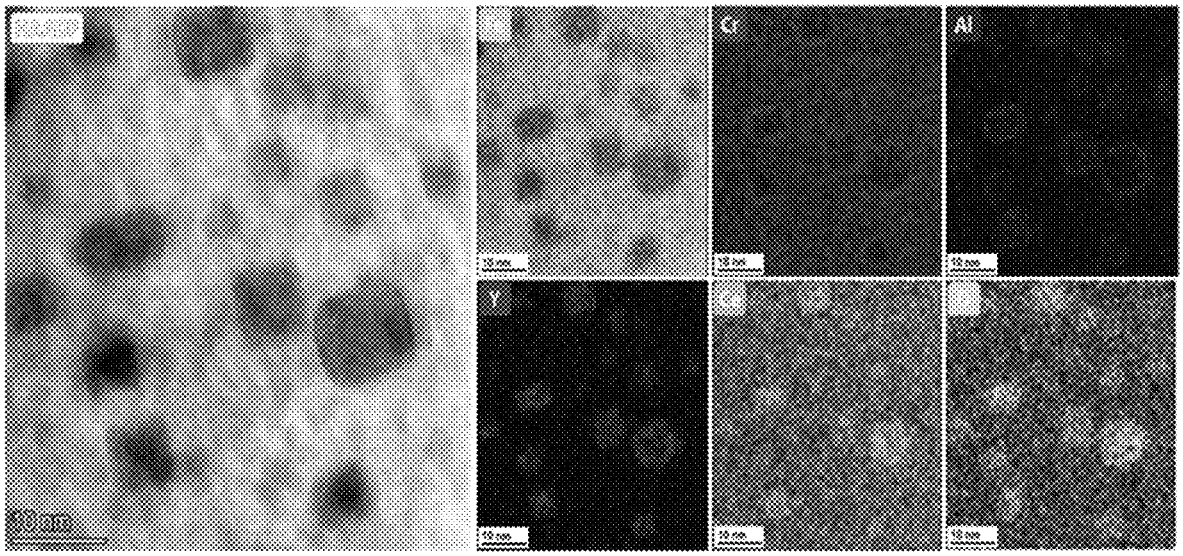
FIG. 3 illustrates a high-angle annular dark field scanning transmission electron microscopy (HAADF-STEM) partial image for the high-density nano-oxides with core-shell structure in the corrosion-resistant ODS steel prepared in Example 1, and corresponding energy dispersive X-ray spectroscopy (EDS) elemental mapping diagrams.

FIG. 3 illustrates a high-angle annular dark field scanning transmission electron microscopy (HAADF-STEM) partial image for the high-density nano-oxides with core-shell structure in the corrosion-resistant ODS steel prepared in Example 1, and corresponding energy dispersive X-ray spectroscopy (EDS) elemental mapping diagrams. As can be seen from FIG. 3 that, for the high-density nano-oxide particles with core-shell structure in the corrosion-resistant ODS steel prepared in Example 1, the component of the core was cerium yttrium oxide (Ce—Y—O), and the shell region (the surface of the cerium yttrium oxide) was enriched in chromium and aluminum.

According to test statistics, the average grain size of the corrosion-resistant ODS steel prepared in Example 1 was 0.36 μm. Tensile properties of the ODS steel at room temperature and high temperature of 700° C. were tested with reference to GB/T 228.1-2010 and GB/T 228.2-2015 respectively (the same below). It was determined that, at the room temperature, the corrosion-resistant ODS steel prepared in Example 1 had a yield strength of 838 MPa, an ultimate tensile strength of 1065 MPa, and an elongation of 15.4%. It was also determined that, at the high temperature of 700° C., the corrosion-resistant ODS steel prepared in Example 1 had a yield strength of 216 MPa, an ultimate tensile strength of 278 MPa, and an elongation of 19.2%. The excellent mechanical properties of the ODS steel in Example 1 mainly derived from fine grain strengthening effect and dispersion strengthening effect of nano-oxides with core-shell structure.

Example 2

A corrosion-resistant oxide dispersion strengthened steel was prepared as follows.

At S1, materials including 9.5 wt % Cr powder, 5.0 wt % Al powder, 0.39 wt % oxygen-containing Ce powder (including 0.35 wt % Ce powder and 0.04 wt % O, that is, the mass of oxygen was 12 wt % of the mass of the Ce powder in the oxygen-containing Ce powder), 0.3 wt % $Y_2O_3$ powder and the balance of Fe powder were prepared, and FeCrAl pre-alloyed powder was made by using the Fe powder, the Cr powder and the Al powder through gas atomization, where an average particle size of the FeCrAl pre-alloyed powder was 10 μm.

At S2, the FeCrAl pre-alloyed powder prepared in step S1 was mixed with the prepared amounts of the oxygen-containing Ce powder and the $Y_2O_3$ powder in a vacuum glove box, the mixed powder was put into a ball mill tank which was in turn assembled into a high-energy ball mill equipped with a gas pressurizing device, and ball milling was performed. An internal gas pressure of the tank was 600 bar, the ball milling was performed at a rotation speed of 320 rpm, a ball-to-powder ratio was 12:1, and the ball milling was performed in an intermittent mode in which the ball milling stopped for 30 minutes after every operation of 60 minutes. A total working time was 36 h, and the ball milling was performed in a protective atmosphere of high-purity argon.

At S3, after completion of the ball milling, the alloyed powder obtained by the ball milling was put into a mold which was in turn placed into a spark plasma sintering furnace, and the alloyed powder was subjected to sintering through a step-wise sintering method. The sintering process was as follows: under a pressure of 70 MPa, a temperature was first raised at a rate of 80° C./min to 800° C. and then kept for 6 min; thereafter, the temperature was raised at the rate of 80° C./min to 1125° C. and then kept for 6 min; finally, the temperature was lowered at a rate of 80° C./min to a room temperature, thereby obtaining the product taken out of the mold as the corrosion-resistant oxide dispersion strengthened steel (ODS-FeCrAl steel). The ODS-FeCrAl steel obtained in this example included: 9.46 wt % Cr, 4.88 wt % A1, 0.33 wt % Ce, 0.22 wt % Y, 0.11 wt % O, 0.0009 wt % C, and the balance of Fe.

It was determined that an average thickness of the oxide layer on a surface of the corrosion-resistant ODS steel prepared in Example 2 after being exposed to high temperature air at 600° C. for 5000 h was 525 nm (which refers to a total thickness of an outer oxide layer and an inner oxide layer, in which a main component of the outer oxide layer was $Al_2O_3$, and a main component of the inner oxide layer was $Cr_2O_3$), and the corrosion resistance of the ODS steel was excellent.

It was determined that an average particle size of the high-density nano-oxides with core-shell structure in the corrosion-resistant ODS steel prepared in Example 2 was 7.15 nm.

According to test statistics, the average grain size of the corrosion-resistant ODS steel prepared in Example 2 was 0.32 μm. It was determined that, at the room temperature, the corrosion-resistant ODS steel prepared in Example 2 had a yield strength of 845 MPa, an ultimate tensile strength of 1088 MPa, and an elongation of 16.5%. It was determined that, at the high temperature of 700° C., the corrosion-resistant ODS steel prepared in Example 2 had a yield strength of 221 MPa, an ultimate tensile strength of 285 MPa, and an elongation of 21.3%.

Example 3

A corrosion-resistant oxide dispersion strengthened steel was prepared as follows.

At S1, materials including 9 wt % Cr powder, 4.5 wt % Al powder, 0.39 wt % oxygen-containing Ce powder (including 0.35 wt % Ce powder and 0.04 wt % O, that is, the mass of oxygen was 12 wt % of the mass of the Ce powder in the oxygen-containing Ce powder), 0.3 wt % $Y_2O_3$ powder and the balance of Fe powder were prepared, and FeCrAl pre-alloyed powder was made by using the Fe powder, the Cr powder and the Al powder through gas atomization, where an average particle size of the FeCrAl pre-alloyed powder was 5 μm.

At S2, the FeCrAl pre-alloyed powder prepared in step S1 was mixed with the prepared amounts of the oxygen-containing Ce powder and the $Y_2O_3$ powder in a vacuum glove box, the mixed powder was put into a ball mill tank which was in turn assembled into a high-energy ball mill equipped with a gas pressurizing device, and ball milling was performed. An internal gas pressure of the tank was 750 bar, the ball milling was performed at a rotation speed of 350 rpm, a ball-to-powder ratio was 15:1, and the ball milling was performed in an intermittent mode in which the ball milling stopped for 30 minutes after every operation of 60 minutes. A total working time was 48 h, and the ball milling was performed in a protective atmosphere of high-purity argon.

At S3, after completion of the ball milling, the alloyed powder obtained by the ball milling was put into a mold which was in turn placed into a spark plasma sintering furnace, and the alloyed powder was subjected to sintering by a step-wise sintering method. The sintering process was as follows: under a pressure of 70 MPa, a temperature was first raised at a rate of 80° C./min to 825° C. and then kept for 8 min; thereafter, the temperature was raised at the rate of 80° C./min to 1135° C. and then kept for 8 min; finally, the temperature was lowered at a rate of 80° C./min to a room temperature, thereby obtaining the product taken out of the mold as the corrosion-resistant oxide dispersion strengthened steel (the ODS steel). The ODS steel obtained in this example included: 8.93 wt % Cr, 4.45 wt % Al, 0.32 wt % Ce, 0.22 wt % Y, 0.10 wt % 0, 0.0012 wt % C, and the balance of Fe.

It was determined that an average thickness of the oxide layer on a surface of the corrosion-resistant ODS steel prepared in Example 3 after being exposed to high temperature air at 600° C. for 5000 h was 408 nm (which refers to a total thickness of an outer oxide layer and an inner oxide layer, in which a main component of the outer oxide layer was $Al_2O_3$, and a main component of the inner oxide layer was $Cr_2O_3$), and the corrosion resistance of the ODS steel was excellent.

It was determined that an average particle size of the high-density nano-oxides with core-shell structure in the corrosion-resistant ODS steel prepared in Example 3 was 8.16 nm.

According to test statistics, the average grain size of the corrosion-resistant ODS steel prepared in Example 3 was 0.28 μm. It was determined that, at the room temperature, the corrosion-resistant ODS steel prepared in Example 3 had a yield strength of 852 MPa, an ultimate tensile strength of 1138 MPa, and an elongation of 18.7%. It was also determined that, at the high temperature of 700° C., the corrosion-resistant ODS steel prepared in Example 3 had a yield strength of 225 MPa, an ultimate tensile strength of 295 MPa, and an elongation of 25.6%.

Comparative Example 1

Comparative Example 1 was different from Example 1 in that: in step S1, materials including 14 wt % Cr powder, 4.5 wt % Al powder, 0.46 wt % oxygen-containing Ce powder (including 0.4 wt % Ce powder and 0.06 wt % O, that is, the mass of oxygen was 15 wt % of the mass of the Ce powder in the oxygen-containing Ce powder), 0.35 wt % $Y_2O_3$ powder, and the balance of Fe powder were prepared. Other preparation operations of this comparative example were the same as those in Example 1. The ODS-FeCrAl steel obtained in Comparative Example 1 included: 13.86 wt % Cr, 4.36 wt % Al, 0.37 wt % Ce, 0.27 wt % Y, 0.14 wt % O, 0.0011 wt % C, and the balance of Fe.

It was determined that an average thickness of the oxide layer on a surface of the corrosion-resistant ODS steel prepared in Comparative Example 1 after being exposed to high temperature air at 600° C. for 5000 h was 416 nm (which refers to a total thickness of an outer oxide layer and an inner oxide layer, in which a main component of the outer oxide layer was $Al_2O_3$, and a main component of the inner oxide layer was $Cr_2O_3$), and the corrosion resistance of the ODS steel was excellent.

It was determined that, at the room temperature, the corrosion-resistant ODS steel prepared in Comparative Example 1 had a yield strength of 762 MPa, an ultimate tensile strength of 932 MPa, and an elongation of 7.8%. It was also determined that, at the high temperature of 700° C., the corrosion-resistant ODS steel prepared in Comparative Example 1 had a yield strength of 202 MPa, an ultimate tensile strength of 255 MPa, and an elongation of 10.5%. The comprehensive mechanical properties were not as good as those in Example 1. This was due to a fact that the higher Cr content made an increase in the brittleness of the material at the high temperature.

Comparative Example 2

Comparative Example 2 was different from Example 1 in that: in step S1, materials including 9 wt % Cr powder, 4.5 wt % Al powder, 0.4 wt % Ce powder, 0.35 wt % $Y_2O_3$ powder, and the balance of Fe powder were prepared. That is, the raw material Ce powder was not subjected to special oxygen adsorption, but was directly subjected to ball-milled together with the FeCrAl pre-alloyed powder and the $Y_2O_3$ powder. Other preparation operations of this comparative example were the same as those in Example 1. The ODS-FeCrAl steel obtained in Comparative Example 2 included: 8.92 wt % Cr, 4.42 wt % Al, 0.37 wt % Ce, 0.28 wt % Y, 0.08 wt % O, 0.0011 wt % C, and the balance of Fe.

As tested, Ce—Y—O nano-oxide particles were observed in the ODS steel prepared in Comparative Example 2, but no shell structure was observed around them. This was due to a fact that the Ce powder did not adsorb O, which led to a direct strong reaction between Ce and $Y_2O_3$ but no in-situ reaction between oxygen-containing Ce and $Y_2O_3$, making it difficult to form a core-shell structure.

It was determined that, at the room temperature, the ODS steel prepared in Comparative Example 2 had a yield strength of 815 MPa, an ultimate tensile strength of 1034 MPa, and an elongation of 13.2%. It was also determined that, at the high temperature of 700° C., the corrosion-resistant ODS steel prepared in Comparative Example 2 had a yield strength of 208 MPa, an ultimate tensile strength of 259 MPa, and an elongation of 17.6%. The comprehensive mechanical properties were not as good as those in Example 1. This was because the toughness of the ODS steel of Comparative Example 2 was decreased due to no or less nano-oxides with core-shell structure formed in the ODS steel.

Comparative Example 3

Comparative Example 3 was different from Example 1 in that: in step S1, materials including 9 wt % Cr powder, 4.5 wt % Al powder, 0.35 wt % $Y_2O_3$ powder, and the balance of Fe powder were prepared, that is, no Ce was added. Other preparation operations of this comparative example were the same as those in Example 1. The ODS-FeCrAl steel obtained in Comparative Example 3 included: 8.95 wt % Cr, 4.35 wt % Al, 0.27 wt % Y, 0.09 wt % O, 0.0011 wt % of C, and the balance of Fe.

After testing, the surface of the ODS steel prepared in Comparative Example 3 was damaged after being exposed to a high temperature air environment of 600° C. for 5000 hours, and no continuous $Cr_2O_3$ was formed in the inner layer. This was because no Ce was added to the ODS steel and the ability of Cr to diffuse outwards was thus decreased, which made it difficult for the ODS steel to generate a continuous and dense $Cr_2O_3$ protective film in a corrosive environment. Thus, the ODS steel had poor high-temperature corrosion resistance.

It was determined that, at the room temperature, the ODS steel prepared in Comparative Example 3 had a yield strength of 797 MPa, an ultimate tensile strength of 925 MPa, and an elongation of 16.3%. It was also determined that, at the high temperature of 700° C., the corrosion-resistant ODS steel prepared in Comparative Example 3 had a yield strength of 193 MPa, an ultimate tensile strength of 236 MPa, and an elongation of 20.8%. The strength of the ODS steel was not as good as that in Example 1. This was because no Ce was added to the ODS steel and thus no cerium yttrium nano-oxide was formed in the ODS steel, resulting in a decrease in the dispersion strengthening effect of the nano-oxides on the ODS steel and a decrease in the strength of the ODS steel.

Comparative Example 4

Comparative Example 4 was different from Example 1 in that the ball milling for the ODS steel in step S2 was carried out at atmospheric pressure, and all other steps are the same as those in Example 1. The ODS-FeCrAl steel obtained in Comparative Example 4 included: 8.97 wt % Cr, 4.43 wt % Al, 0.38 wt % Ce, 0.27 wt % Y, 0.15 wt % O, 0.0011 wt % of C, and the balance of Fe.

It was determined that the average grain size of the ODS steel prepared in Comparative Example 4 was 0.78 μm.

After testing, the surface of the ODS steel prepared in Comparative Example 4 was damaged after being exposed to a high temperature air environment of 600° C. for 5000 hours, and no continuous $Cr_2O_3$ was formed in the inner layer. This was because the ball milling was performed on the powder at the atmospheric pressure, which resulted in a larger grain size of the ODS steel, a lower grain boundary density, and decreased Cr diffusion channels, making it difficult for the ODS steel to generate a continuous and dense $Cr_2O_3$ protective film in the corrosive environment. Thus, the ODS steel had poor high-temperature corrosion resistance.

It was determined that, at the room temperature, the ODS steel prepared in Comparative Example 4 had a yield strength of 715 MPa, an ultimate tensile strength of 898 MPa, and an elongation of 12.6%. It was also determined that, at the high temperature of 700° C., the corrosion-resistant ODS steel prepared in Comparative Example 4 had a yield strength of 186 MPa, an ultimate tensile strength of 224 MPa, and an elongation of 16.5%. The comprehensive mechanical properties were not as good as those in Example 1. This was because the ball milling was performed on the powder at the atmospheric pressure, which resulted in a larger grain size of the ODS steel and thus a decrease in the fine-grain strengthening effect.

Comparative Example 5

Comparative Example 5 was different from Example 1 in that a one-step sintering method was adopted in the process of spark plasma sintering in S3. Specifically, the sintering process in Comparative Example 5 was as follows: under a pressure of 80 MPa, a temperature was raised at a rate of 100° C./min directly to 1130° C. and kept for 8 min, then the temperature was lowered at a rate of 100° C./min to a room temperature, thereby obtaining the taken out product as the ODS steel. That is, in this comparative example, the step of keeping at 780° C. for 8 minutes was omitted, and other parameters were the same as those in Example 1. The ODS-FeCrAl steel obtained in Comparative Example 5 included: 8.94 wt % Cr, 4.46 wt % Al, 0.36 wt % Ce, 0.28 wt % Y, 0.15 wt % O, 0.0012 wt % C, and the balance of Fe.

It was determined that the average grain size of the ODS steel prepared in Comparative Example 5 was 0.37 μm. There were many holes and gaps between the grains in the ODS steel, and the density of the ODS steel was not as good as that of Example 1. This showed that first keeping at a lower temperature for a certain period of time (two-step sintering method) would not significantly increase the grain size of the ODS steel, but promotes contact and adhesion between the powders obtained after the ball milling. The powders obtained after the ball milling were relatively soft at this lower temperature, and were able to move short distances before arrival of the maximum temperature, and a sintering neck was formed, which helps to ultimately obtain the material with compact structure.

It was determined that, at the room temperature, the corrosion-resistance ODS steel prepared in Comparative Example 5 had a yield strength of 724 MPa, an ultimate tensile strength of 923 MPa, and an elongation of 9.5%. It was also determined that, at the high temperature of 700° C., the corrosion-resistant ODS steel prepared in Comparative Example 5 had a yield strength of 185 MPa, an ultimate tensile strength of 247 MPa, and an elongation of 13.6%. The comprehensive mechanical properties were not as good as those in Example 1. This was because the ODS steel obtained from one-step sintering method had relatively low structural density and certain defects such as holes, which led to a decrease in the mechanical properties.

The above-described embodiments only describe the preferred implementations of the present disclosure and do not limit the scope of the disclosure. Without departing from the spirit of the design of the disclosure, various deformations and improvements made to the technical solutions of the disclosure by those of ordinary skill in the art shall fall within the protection scope determined by the claims of the present disclosure.

What is claimed is:

1. An oxide dispersion strengthened steel, comprising in percentage by mass: Cr at 8.0 wt %-10.0 wt %, Al at 4.0 wt %-6.0 wt %, Ce at 0.2 wt %-0.8 wt %, Y at 0.2 wt %-0.4 wt %, O at 0.05 wt %-0.3 wt %, C at less than or equal to 0.00 16 wt %, and balance of Fe;

wherein a method for preparing the oxide dispersion strengthened steel comprises:

preparing materials comprising, in percentage by mass, Cr powder at 8.0 wt %-10.0 wt %, Al powder at 4.0 wt %-6.0 wt %, oxygen-containing Ce powder at 0.21 wt %-1.0 wt %, $Y_2O_3$ powder at 0.3 wt %-0.5 wt %, and balance of Fe powder, and making FeCrAl pre-alloyed powder by using the Cr powder, the Al powder and the Fe powder through gas atomization;

mixing the FeCrAl pre-alloyed powder with the oxygen-containing Ce powder and the $Y_2O_3$ powder, and performing ball milling on the mixed powder; and sintering alloyed powder obtained after the ball milling, thereby obtaining the oxide dispersion strengthened steel;

wherein the ball milling is performed at a rotation speed of 220 rpm-350 rpm, a ball-to-powder ratio is 10:1-15:1, the ball milling is performed in an intermittent mode, a total working time is 36 h-64 h, the intermittent mode comprises stopping the ball milling for 15 min-60 min after every operation of 30 min-120 min, and the ball milling is performed under a gas pressure of 100 bar-1000 bar;

wherein the sintering adopts a step-wise sintering method, and comprises: under a pressure of 50 MPa-100 MPa, first raising a temperature to 700° C.-850° C. and keeping it for 5 min-10 min, then raising the temperature to 1000° C.-1200° C. and holding it for 5 min-10 min, thereafter lowering the temperature to a room temperature, and the temperature is raised and lowered both at a rate of 50° C./min-120° C./min; and wherein an average particle size of the FeCrAl pre-alloyed powder is 1 μm-10 μm, and an average particle size of the $Y_2O_3$ powder is 50 nm-1 μm.

2. The oxide dispersion strengthened steel as claimed in claim 1, wherein the oxide dispersion strengthened steel uses FeCrAl as a matrix, and cerium yttrium oxide nano-particles with core-shell structure are dispersively distributed in the matrix.

3. The oxide dispersion strengthened steel as claimed in claim 2, wherein a core of the cerium yttrium oxide nano-particle with core-shell structure is a cerium yttrium oxide core, a shell thereof is enriched in chromium and aluminum, and a particle size of the cerium yttrium oxide nano-particle with core-shell structure is 2 nm-100 nm.

4. The oxide dispersion strengthened steel as claimed in claim 1, wherein the oxygen-containing Ce powder is obtained by performing oxygen adsorption on Ce powder, a mass of oxygen is 5 wt %-25 wt % of a mass of the Ce powder in the oxygen-containing Ce powder, and a particle size of the Ce powder is 50 nm-1 μm.

5. The oxide dispersion strengthened steel as claimed in claim 4, wherein performing the oxygen adsorption comprises: introducing oxygen into a container for 5 min-20 min in advance, then putting the Ce powder into the container, and continuously introducing the oxygen until the mass of the Ce powder is increased by 5 wt %-25 wt %.

* * * * *